United States Patent [19]

Simpson

[11] Patent Number: 4,691,628

[45] Date of Patent: Sep. 8, 1987

[54] METHOD FOR DEWATERING A MASS OF WET FIBROUS MATERIAL

[75] Inventor: Edwin K. Simpson, Cordele, Ga.

[73] Assignee: Harris Press and Shear, Inc., Cordele, Ga.

[21] Appl. No.: 922,958

[22] Filed: Oct. 24, 1986

Related U.S. Application Data

[62] Division of Ser. No. 861,936, May 12, 1986.

[51] Int. Cl.[4] ..... B30B 9/06

[52] U.S. Cl. ..... 100/37; 100/98 R; 100/116; 100/127; 100/215; 100/245; 100/249; 100/42

[58] Field of Search ..... 100/37, 39, 104, 110, 100/116, 126, 127, 125, 129, 98 R, 215, 245, 249, 42, 232

[56] References Cited

U.S. PATENT DOCUMENTS

| | | | |
|---|---|---|---|
| 1,110,283 | 9/1914 | Beaston | 100/249 X |
| 2,984,172 | 5/1961 | Roberts | 100/249 X |
| 3,451,190 | 6/1969 | Tezuka | 100/127 X |
| 4,121,515 | 10/1978 | Tea | 100/98 R |
| 4,149,457 | 4/1979 | Smith | 100/98 R |
| 4,417,510 | 11/1983 | Sharp | 100/249 X |
| 4,467,715 | 8/1984 | Bunger | 100/116 X |
| 4,619,194 | 10/1986 | Pierce | 100/249 |
| 4,630,535 | 12/1986 | Haygreen | 100/127 |

*Primary Examiner*—Werner H. Schroeder
*Assistant Examiner*—Andrew M. Falik
*Attorney, Agent, or Firm*—Cushman, Darby & Cushman

[57] ABSTRACT

A method for operating a dewatering press wherein a mass for wet fibrous material is dewatered on all six sides by compressing the mass with a second ram against a plurality of liners arranged on a front face of the second ram, on a rear face of a door, and on a top wall, a bottom wall, and two opposing side walls of a press box. Before entering the press box, a quantity of the mass of wet fibrous material is selected by a first ram which is guided a predetermined distance beneath a hopper of wet fibrous material by a pair of piston rods and cylinders arranged on opposite external sides of the first ram. On one side edge of the front face of the second ram and also on one side wall of the press box, there are positioned four-edged knives which cut off a selected quantity of wet fibrous material after such material is fed into the compression chamber but before such material is pushed into the press box by the second ram.

3 Claims, 8 Drawing Figures

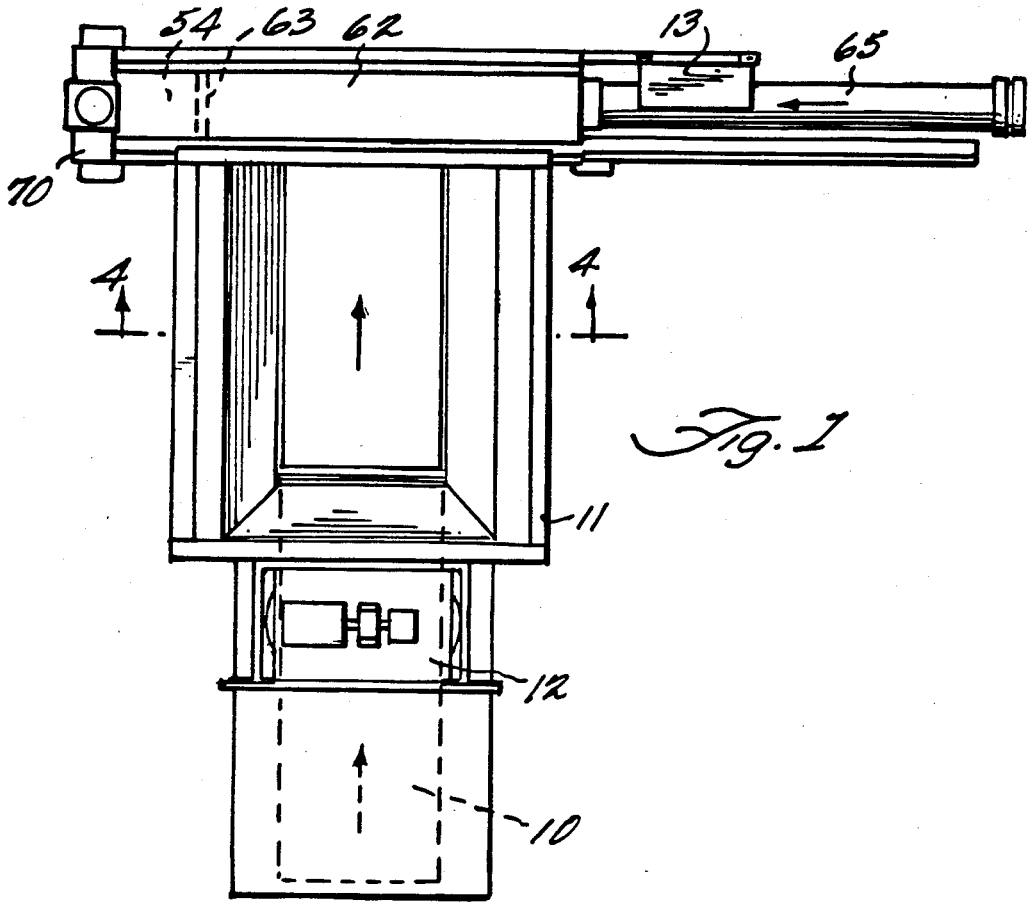
Fig. 1
Fig. 2
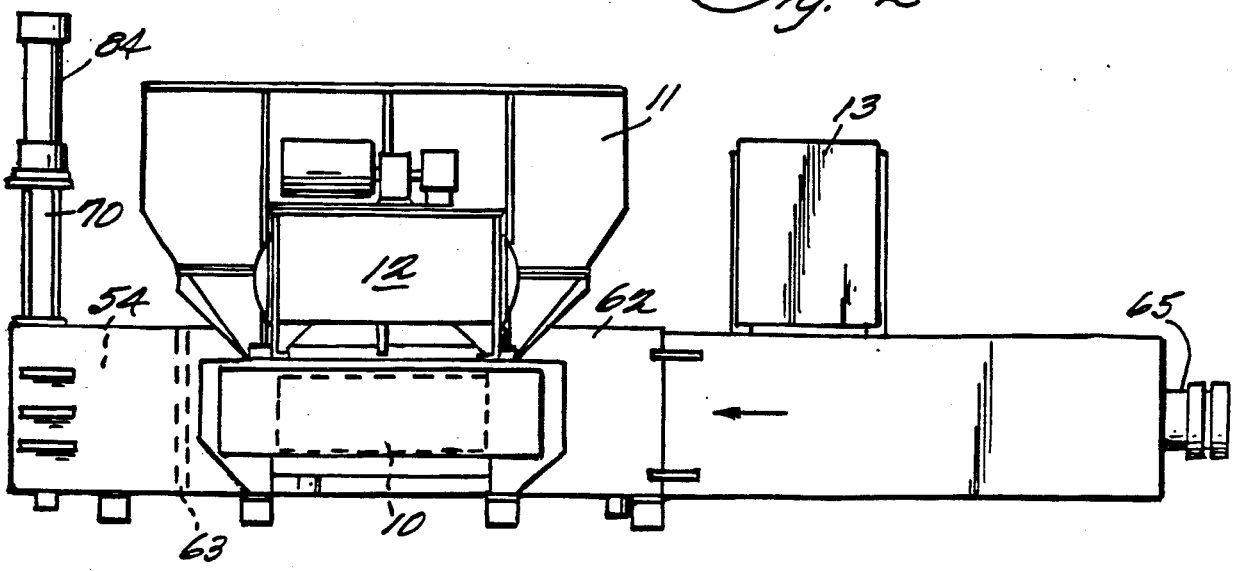

METHOD FOR DEWATERING A MASS OF WET FIBROUS MATERIAL

This is a division of application Ser. No. 861,936, filed May 12, 1986, pending.

BACKGROUND OF THE INVENTION

1. Field of the Invention

This invention relates to a dewatering press, i.e. a machine for compressing materials mixed with or having liquids absorbed therein to remove liquids therefrom.

2. Description of the Prior Art

The paper industry has a problem in the disposal of pulper rejects where the primary feed stock is waste papers. Such rejects may include fiber, plastics, metals, cloth, rubber, etc. but mostly water from the screening process which contributes most of the weight of such rejects. The disposal of such heavy rejects or waste is costly not only in transportation but also, particularly in populous areas, where depositing or "tipping" fees at landfills are high and assessed by weight. Similar problems exist in the transportation and handling of biomass fuels which have a high liquid content.

Nevertheless, there are prior art devices known for removing water from waste products. For example, Tezuka shows in U.S. Pat. No. 3,451,190 a refuse disposal device having feeding and compression boxes. However, only the bottoms of the boxes are provided with drainage holes for the water, thus leaving large amounts of water in the refuse.

Another example of the prior art is known from Bunger who discloses a moisture reducing ram press in U.S. Pat. No. 4,467,715. In the press of Bunger, horizontally extending drainage grooves are arranged in opposed grates. One of the grates is movable by a hydraulic cylinder toward the other grate which is fixed so that fibrous waste material between the two grates is dewatered. The drainage grooves are then relieved rearwardly and the dewatered waste material is subsequently ejected downwardly at right angles to such horizontal drainage grooves in the grates.

Other apparatuses having drain holes for allowing extracted liquids to leave a mass of compressed materials are disclosed in U.S. Pat. Nos. 2,984,172; 2,711,642; 2,427,446; 1,980,000; 1,553,310; 1,231,929; and 734,591.

SUMMARY OF THE INVENTION

Accordingly, it is an object of this invention to provide an improved press especially useful for removing water from pulper rejects where the primary stock is waste paper. Such removed water presents no disposal problem because of the water recycling system already present in a paper plant.

It is another object of this invention to provide such a press which will effect a weight reduction of such "wet" waste of from $\frac{1}{2}$ to $\frac{2}{3}$ of the wet weight and a volume reduction of the order of one-half. The economic savings in transportation for disposal of and possible deposit fees at landfills for such dewatered waste are substantial.

It is another object of this invention to provide such a press that will produce dewatered material that will be dry enough to burn and thus eliminate transportation and landfill fees with the further possible benefit of using such material as a fuel to generate steam or electrical energy.

These objects are attained by a press that has an open-top feed hopper through the lower portion of which the head of a feeder or charging ram advances to push the wet waste material.

Other objects and advantages of the invention will become apparent from the following description and accompanying drawings.

BRIEF DESCRIPTION OF THE DRAWINGS

FIG. 1 shows a top plan view of a hopper and a main compressing ram cylinder.

FIG. 2 shows a side elevational view of the hopper and a control panel for the main compression ram cylinder.

DETAILED DESCRIPTION OF THE PREFERRED EMBODIMENTS

Figure 3:
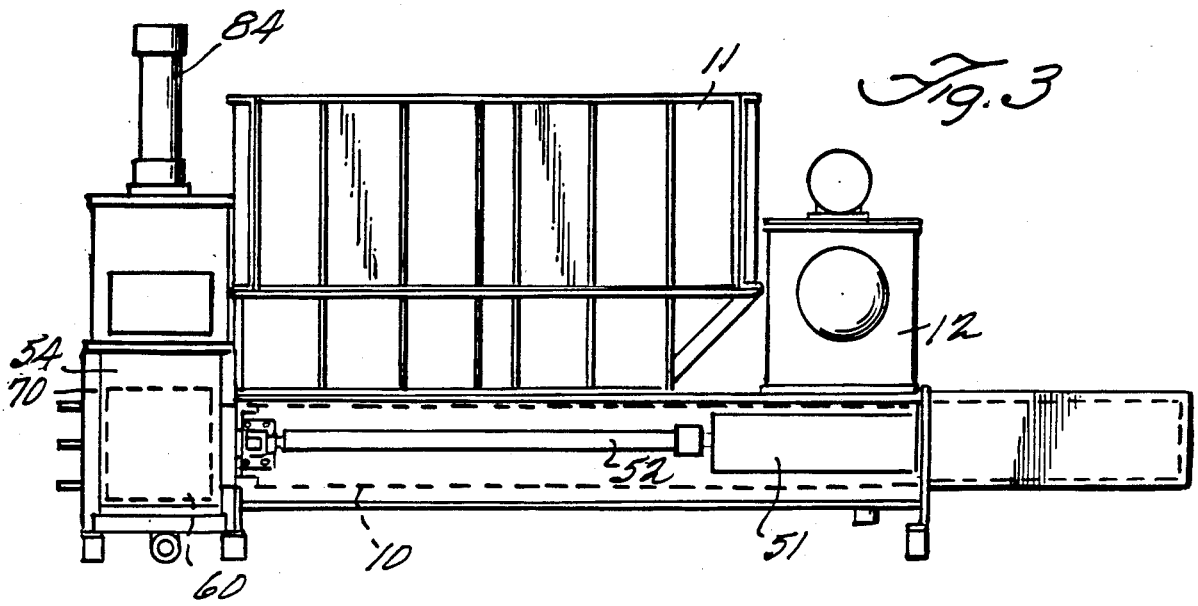
FIG. 3 shows a front elevational view of the hopper and a hydraulic power unit for the main compression ram cylinder.

In FIG. 1, there is shown a dewatering press having a hopper 11 for receiving wet fibrous material, a feeder ram 10 for forcing the wet fibrous material into a compression chamber 62, a hydraulic power unit 12 for the driving of the feeder ram 10 and all other hydraulic cylinders of the press a main compression ram 63 arranged substantially perpendicular to the feeder ram 10, and a panel box 13 for controlling the driving of the main compression ram 63 toward a press box 54.

As shown in FIG. 2, after the feeder ram 10 has pushed a quantity of wet fibrous material into the compression chamber 62, the main compression ram 63 forces the wet fibrous material through the compression chamber 62 into a compressed mass in the press box 54 where the wet fibrous material is dewatered in a manner to be described later. A cylinder 84 raises and lowers a door 70 which opens and closes whenever a bale of dewatered fibrous material is ejected from the press box 54.

Another view of the dewatering press is shown in FIG. 3 in which the feeder ram 10 is fully extended by control signals sent from the panel box 13 to cylinders 51 in which piston rods 52 reciprocate so that wet fibrous material is pushed from the bottom of the hopper 11 to the left for eventual dewatering by the front face 60 of the ram 63 in the press box 54. The cylinder 84 has lowered the door 70 into its closed position.

Figure 4:
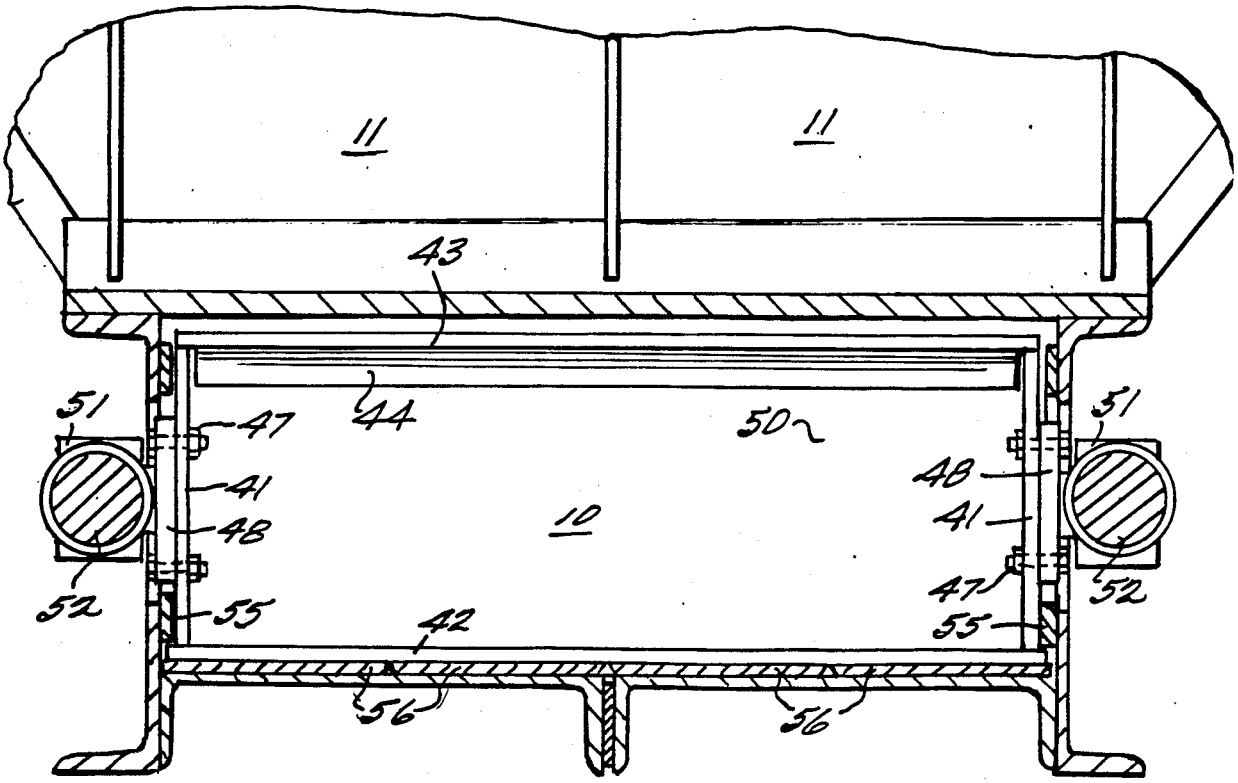
FIG. 4 shows a rear view of a feeder ram section of a feeder box positioned below the hopper.
Figure 5:
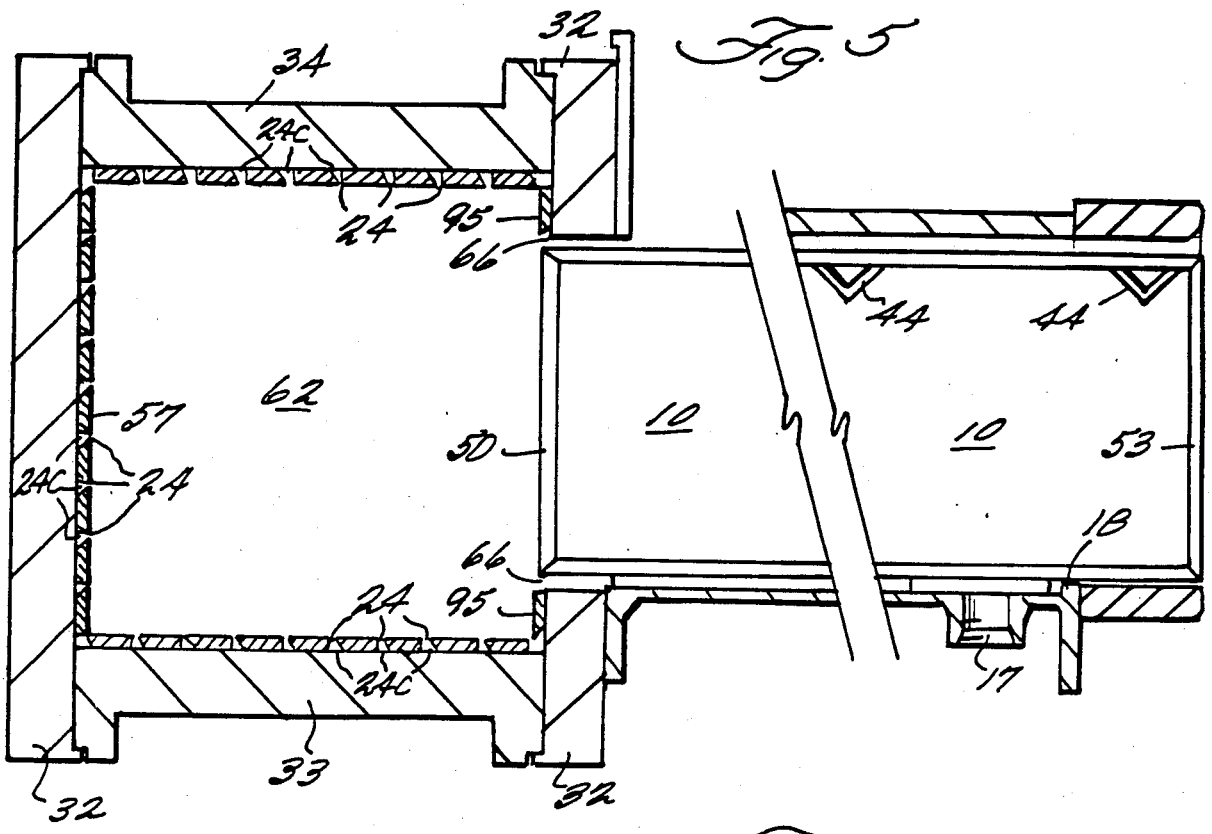
FIG. 5 shows a side elevational view of the feeder ram section of the feeder box with elements for allowing expressed liquids to leave.

As shown in FIG. 4, the feeder ram 10 is constructed of a top plate 43, a bottom plate 42, two side plates 41, a front plate S50 (FIG. 5), and stiffeners 44 for the top plate 43. Two cylinders 51 arranged on opposite external sides actuate the feeder ram 10. Piston rods 52 inside the cylinders 51 are connected to each side plate 41 by eye brackets 47 and a female rod clevis 48. This external assembly for attaching the piston rods 52 to the feeder ram 10 is located entirely along the outside of the side plates 41 extending from the front plate 50 (FIG. 5) to a back plate 53 (FIG. 5). Retraction of the pair of piston rods 52 in the cylinders 51 on the side plates 41 causes the feeder ram 10 to be pulled toward the compression chamber 62 (FIG. 5).

As also shown in FIG. 4, the feeder ram 10 has its bottom plate 42 supported by a plurality of bottom liner plates 56. The bottom plate 42 of the feeder ram 10 extends under side liner plates 55 to guide the feeder ram 10 toward the compression chamber 62 (FIG. 5). Side-to-side guidance of the feeder ram 10 is also accomplished by the side liner plates 55.

Figure 6:
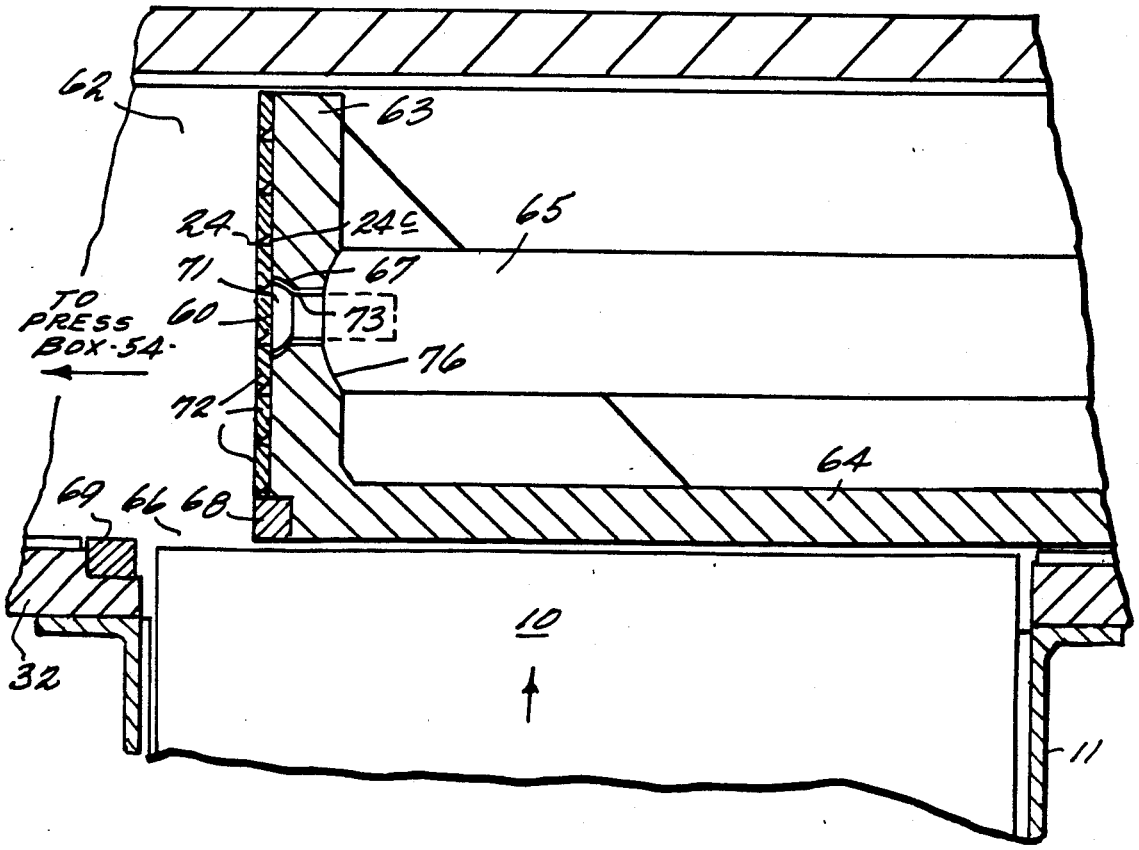
FIG. 6 shows the main compression ram cylinder having drainage slots on its face.

In FIG. 6, drain slots 24 are shown on a front face 60 of a main compression ram 63. In FIG. 5, identical drain slots are also located in the bottom plate 33, the top plate 34, and in side plates 32 of the compression chamber 62. Liquid is eventually expressed from all sides forming the press box 54 at one end of the compression chamber 62. It should be noted that the drain slots in the ram and in the bottom and top plates of the compression chamber 62 are aligned with each other in order to facilitate the extraction of liquid from the fibrous waste paper being compressed.

Also as shown in FIG. 5, the drain slots 24 are uniform in width in order to prevent the fibrous material from wedging inside the slots 24 during any motion in the direction of the longitudinal axes of the various drain slots 24. Each drain slot 24 must have its longitudinal axis oriented in the primary direction of motion of the feeder ram 10 which effectively moves along its own parallel longitudinal axis. Thus, the orientation of the drain slots 24 aids in the movement of the fibrous material into the press box 54 by not restricting such movement in any way.

Figure 7:
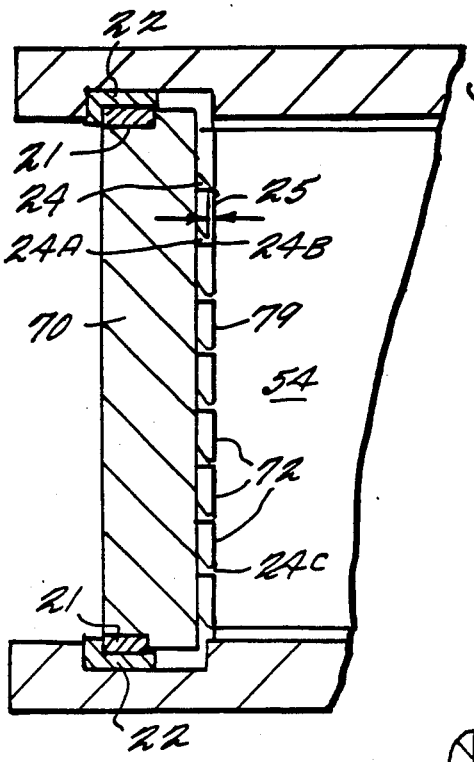
FIG. 7 shows a top plan view of a door which provides reaction to material being forced against it by the main compression ram cylinder.

As best shown in FIG. 7, each drain slot 24 has a straight bored portion 24B and a widened relief portion 24A. Thus, a substantially constant flat area or thick portion 25 on a replaceable rear face 79 of a door 70 is provided so that progressive wear of the rear face 79 does not increase the opening 24C in each drainage slot 24. It has been discovered that the critical dimension of the opening 24C in each drainage slot 24 is 1/32 inch which must not be exceeded in order to retain the fibrous waste material under dewatering pressure in the press box 54.

Identical dimensions are also necessary for the openings 24C in the drainage slots 24 in the front face 60 of the main compression ram 63 shown in FIG. 6, and as shown in FIG. 5, in the bottom plate 33, the top plate 34, and the side plates 32 of the compression chamber 62.

Also as shown in FIG. 7, the widened relief portion 24A in each drainage slot 24 is tapered outwardly away from the press box 54 so that there is a low pressure flow path for the water expressed from the fibrous waste material being compressed in the press box 54. Furthermore, the widened relief portion 24A allows any small fibrous waste material which may be forced into one or more of the drainage slots 24 to be freely washed away with the expressed water without causing clogging of the straight bored portion 24B of the drainage slots 24.

Figure 8:
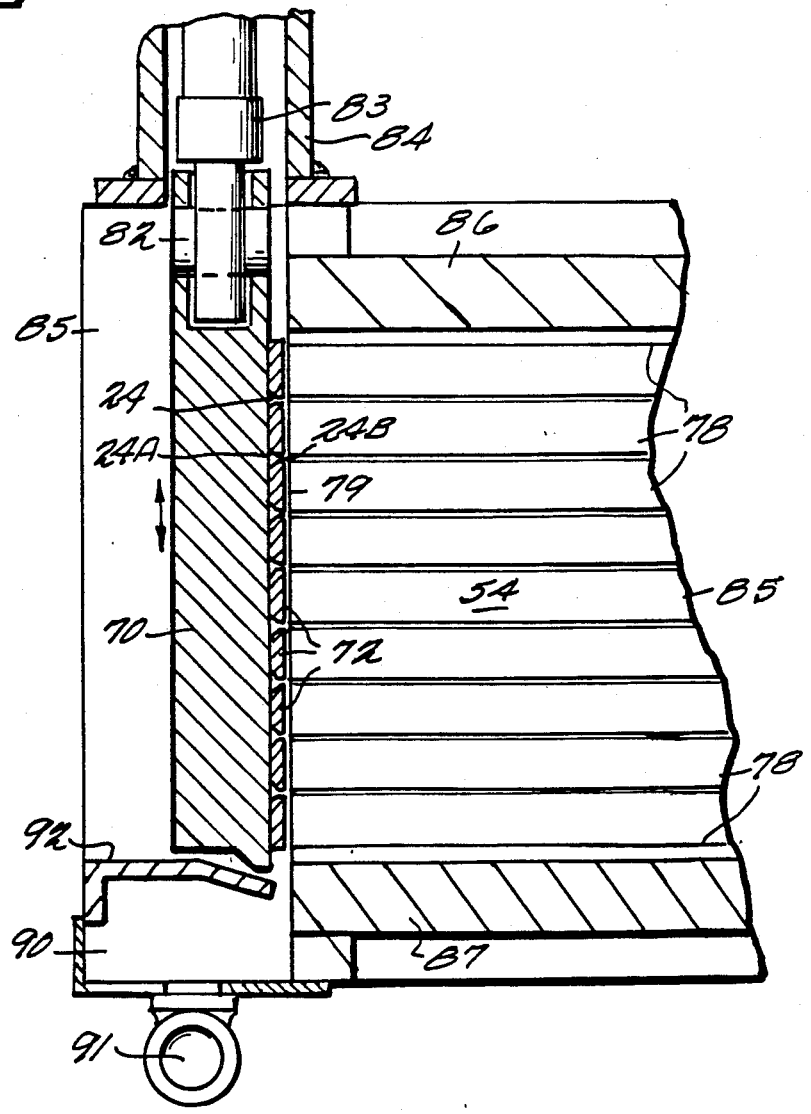
FIG. 8 shows a detailed cross-sectional view of the door shown in FIG. 7.

Alternatively, as shown in the embodiment of FIG. 8, the relief portion 24 of each drainage slot 24 may be widened into a conical shape completely around the straight bored portion 24B so that each drainage slot 24 will have twice the water flow capacity as the drainage slots 24 shown in the embodiment of FIG. 7.

Referring again to FIG. 6, a main compression ram 63 is guided on all four sides through a compression chamber 62. Part of the compression chamber 62 includes a charge opening 66. As shown in FIG. 5, two corner liners 95 are continued above and below the charge opening 66 to assure guidance of the main compression ram 63.

Returning to FIG. 6, it may be seen that the amount of material charged into the compression chamber 62 is pushed thereinto by the feeder ram 10. This charging is accomplished, as shown in FIG. 4, when the feeder ram 10 removes a lower portion of the material in a hopper 11 and charges it into the compression chamber 62 shown in FIGS. 1 and 2. The starting and stopping positions of the feeder ram 10 are controlled by an operator of the feeder control panel box 13 to vary the amount of charge being loaded into the compression chamber 62.

Referring again to FIG. 5, the side plates 32 of the compression chamber 62 are symmetrical in their mounting configuration so that they can be assembled to either the left side or the right side. The feeder ram 10 and the hopper 11 can then be mounted for either a right hand or a left hand configuration. The result is that the same parts are used for opposite hand configurations. For example, as shown in FIG. 3, the feeder ram 10 and the hopper 11 are mounted in a configuration on the right hand side of the press box 54.

Returning to FIG. 5, provision is made for the collection by water and other liquids during the operation of the machine by directing liquids to various exit locations which may be constituted by a plurality of similar pipe fittings 17 and dams 18.

As indicated earlier in regard to FIG. 6, the main compression ram 63 has drainage slots 24 on its front face 60. This face 60 is formed by a plurality of spaced wear liners 72. The main compression ram 63 also has a vertical knife 68 which works against a vertical knife 69 in the edge of the side wall 32 near the entrance to the press box 54. These knives 68 and 69 provide the cutting edges necessary to separate the moving charged material from the waiting material beneath the hopper 11. This cutting function becomes important when the feeder ram 10, as shown in FIG. 1, is not fully stroked underneath the hopper 11.

Referring again to FIG. 6, the main compression ram 63 has a side extension 64 which covers the charge opening 66 to keep waiting material in the hopper 11 from falling behind the front face 60 of the main compression ram 63. Thus, inadvertent damage is prevented to a single centered rod 65 which pushes the front face 60 forward. A spherical bearing surface 76 connects the body of the compression ram 63 to the pushing rod 65 in order to isolate the rod 65 from "cocking moments" which the rod 65 would otherwise experience from ram 63. The "cocking moments" are tendencies of the ram 63 to jerk the rod 65 in various transverse directions due to uneven resistance offered by the material being compressed by the front face 60 of the ram 63. The isolation of such "cocking moments" is also effected during pull back of the ram 63 and rod 65 because a mounting bolt 71 is likewise provided with a spherical bearing surface 67. A clearance 73 is provided so that the two spherical bearing surfaces 67 and 76 are not held in contact simultaneously by the mounting bolt 71 which would cause an undersirable rigid point. The provision of only a single centered mounting bolt 71 accessible from the front face 60 of the ram 63 makes it very easy and convenient for the operator to remove the ram 63 from the compression chamber 62.

In the arrangement of the present invention, the door 70 forming one side of the press box 54 in FIG. 7 is not shown at the left hand side of the ram 63 in FIG. 6. The function of the door 70 in FIG. 7 is to provide a reaction surface to the material being compressed against it by the ram 63. The door 70 also functions to contain the material being dewatered and aids in the routing of the water by providing exits through the drainage slots 24 discussed earlier and formed by spacing between a plurality of replaceable liners 72 identical to the liners 72 (FIG. 6) on the front face 60 of the ram 63. Another feature of the door 70, as shown in FIG. 7, is that it is equipped with replaceable wear strips 21 and 22. These strips 21 and 22 are replaced whenever the edges of the door 70 become worn because of the compression of the edges against the edges of the press box 54. The replacement of only these strips 21 and 22 saves the cost of replacing the entire door 70 and the cost of rebuilding the edges of the press box 54.

A detailed cross sectional view of the door 70 is shown in FIG. 8. A knuckle 83 is attached to the door 70 by a pin 82. A cylinder 84 is mounted to a top wall 86 of the press box 54 and serves to receive the door 70 which is raised to allow the compressed and dewatered fibrous material to be ejected from the press box 54. The press box 54 also has a bottom wall 87 and a side wall 85 which receives the door 70 whenever it is lowered. In addition to the plurality of replaceable liners 72 on the rear face 79 of the door 70, there is a plurality of replaceable liners 78 on the side walls 85, top walls 86, and bottom wall 87 of the press box 54 for receiving water expressed from the fibrous material being compressed and dewatered in the press box 54. A catch pan 90 receives the water which has been expressed from the fibrous material and such water exits the catch pan 90 through a pipe connector 91.

A floor 92 for the door 70 serves as a bottom rest for the door 70 when the door 70 is completely lowered. The floor 92 also functions as a cover for the catch pan 90 and as a support for the bale of compressed fibrous material being ejected from the press box 54.

There are three modes of operating the dewatering press: manual, semi-automatic, and automatic. Manual operation is intended for setting up and performing maintenance on the dewatering press. Semi-automatic and automatic modes are intended for unattended operation of the apparatus.

The automatic sequence is described as follows. The operation starts with all elements in the ready position shown in FIG. 1. The door 70 is down, the feeder ram 10 is retracted, and the main compression ram 63 is also retracted. First, the operator manipulates dials (not shown) on panel box 13 to select either full or partial extension of the feeder ram 10 so that the amount of wet fibrous material dropping down from the hopper 11 is limited by the presence of the feeder ram 10 beneath the hopper 11. Upon cycle initilization by the operator, the feeder ram 10 is extended to charge the compression chamber 62. As shown in FIG. 5, the front face 50 of the feeder ram 10 is held at the charge opening 66. As shown in FIG. 1, the main compression ram 63 is then fully extended to drive the wet fibrous material from the compression chamber 62 into the press box 54. Actually, as shown in FIG. 6, the press box 54 is a volume of space which extends beyond the charge opening 66 at a far end of the compression chamber 62. As shown in FIG. 1, the wet fibrous material is held in the press box 54 against the door 70 by the main compression ram 63 preferably for about a minute under about 500 pounds per square inch of pressure. However, any other amount of time and pressure may be selected as long as the wet fibrous material is dewatered. After the selected holding time ends, the ram 63 is retracted a few inches to allow the door 70, as shown in FIG. 2, to be raised by the cylinder 84. The main ram 63 on rod 65 then moves forward again until the newly formed block of dewatered fibrous material is completely ejected from the press box 54. Thereafter, the main ram 63 retracts completely to the right hand side of the compression chamber 62, the door 70 closes, and the feeder ram 10 also retracts. This sequence of steps is repeated automatically until interrupted by the operator.

The semi-automatic sequence is the same as the automatic sequence described above except that, during the step of dewatering the wet fibrous material by the fully extended main compression ram 63, if no pressure exists against the ram 63, thus indicating that no material is present in the compression chamber 62, the controls in the panel box 13 will return all elements to the initial ready condition with hydraulic pumps 12 for driving the feeder ram 10 and the main compression ram 63 being unloaded to a low horsepower "idle" position. This initial ready condition will then be maintained until the operating sequence is again commenced by the operator.

One other point should also be made in regard to another key operational feature of the present invention. As shown in FIG. 6, during the first step of the extension of the main compression ram 63 before the knives 68 and 69 pass each other, the hydraulic pressure available for cutting the fibrous material in the charge opening 66 is reduced. This reduced pressure prevents damage which may result to the dewatering press if the full force of the main compression ram 63 were immediately applied to cut the solid mass of fibrous material in the charge opening 66.

Certain other points should also be made in regard to the construction of the dewatering press. Major subassemblies of the invention are made of heavy metal plates which are stress-relieved before being machined to the preferred design dimensions. The main compression ram 63 and the press box 54 are equipped with replaceable shear knives 68 and 69 shown in FIG. 6. All four edges of the knives 68 and 69 are usable so that the edges of such knives 68 and 69 may be turned into place for shearing purposes after another set of edges is worn out. Thus, such knives 68 and 69 last four times as long as conventional knives which have only one set of cutting edges exposed toward each other.

Also, all piping elements, such as the pipe connection 91 shown in FIG. 8, are electrically welded so as to be securely anchored to the dewatering press. Furthermore, any flanges used with such piping elements are made of steel and bolted to the dewatering press with "O"-ring gaskets arranged therebetween.

The foregoing preferred embodiment is considered illustrative only. Numerous other modifications will readily occur to those persons skilled in the pertinent art. Consequently, the disclosed invention is not limited to the exact construction shown and described but is rather defined by the following claims.

I claim:

1. A method for dewatering a mass of wet fibrous material, comprising the steps of:

containing a mass of wet fibrous material in a hopper;

selecting a given quantity of the mass of wet fibrous maerial by adjusting a first ram a predetermined distance beneath the hopper;

feeding the selected quantity of the mass of wet fibrous material into a compression chamber by guiding the first ram in a direction of movement toward the compression chamber via a pair of piston rods and cylinders arranged on opposite sides outside of the first ram;

feeding the selected quantity of wet fibrous material from the compression chamber into a press box by a second ram moving in a direction substantially perpendicular to the direction of the movement of the first ram;

lowering a door located at one end of the press box so that the wet fibrous material is pushed thereagainst by the second ram;

compressing the wet fibrous material in the press box by the second ram into a bale;

expressing water from the wet fibrous material being compressed in the press box by the second ram; and channeling the water expressed from the fibrous material along a plurality of liners arranged on a front face of the second ram, on a rear face of the door, and on a top wall, a bottom wall, and two opposing side walls of the press box;

whereby the mass of wet fibrous material is efficiently dewatered from all six sides.

2. The method according to claim 1, further comprising the step of:

cutting off the selected quantity of the mass of wet fibrous material by using four-edged knives positioned both on one side edge of the front face of the second ram and on one side wall of the press box subsequent to the step of feeding the wet fibrous material into the compression chamber.

3. The method according to claim 1, further comprising the subsequent steps of:

raising the door at the one end of the press box; and ejecting the dewatered fibrous material formed into the bale out of the press box by the second ram.

* * * * *